US011131302B2

(12) United States Patent
Cho et al.

(10) Patent No.: US 11,131,302 B2
(45) Date of Patent: Sep. 28, 2021

(54) SCROLL COMPRESSOR WITH IMPROVED VALVE INSTALLATION

(71) Applicant: SAMSUNG ELECTRONICS CO., LTD., Suwon-si (KR)

(72) Inventors: Nam Kyu Cho, Anyang-si (KR); Yang Sun Kim, Anyang-si (KR); Jung-Hoon Park, Suwon-si (KR); Jong Eun Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/643,753

(22) PCT Filed: Aug. 29, 2018

(86) PCT No.: PCT/KR2018/010004

§ 371 (c)(1),
(2) Date: Mar. 2, 2020

(87) PCT Pub. No.: WO2019/045454

PCT Pub. Date: Mar. 7, 2019

(65) Prior Publication Data

US 2021/0131427 A1 May 6, 2021

(30) Foreign Application Priority Data

Sep. 1, 2017 (KR) ..... 10-2017-0111664

(51) Int. Cl.
*F04C 2/02* (2006.01)
*F04C 18/02* (2006.01)
(Continued)

(52) U.S. Cl.
CPC ..... *F04C 2/025* (2013.01); *F04C 18/0215* (2013.01); *F04C 18/0253* (2013.01);
(Continued)

(58) Field of Classification Search
CPC ..... F04C 2/025; F04C 18/0207–0223; F04C 18/0253; F04C 18/0261;
(Continued)

(56) References Cited

U.S. PATENT DOCUMENTS 5,173,042 A * 12/1992 Chambers ..... F04C 18/0215 137/543.19
6,132,191 A * 10/2000 Hugenroth ..... F04C 29/126 137/220
(Continued)

FOREIGN PATENT DOCUMENTS

CN 103541901 A 1/2014
EP 3339646 A1 * 6/2018 ..... F04C 28/26
(Continued)

OTHER PUBLICATIONS

Extended European Search Report dated Jul. 17, 2020 in European Patent Application No. 18852289.0.
(Continued)

*Primary Examiner* — Laert Dounis
(74) *Attorney, Agent, or Firm* — Staas & Halsey, LLP

(57) ABSTRACT

A scroll compressor to prevent reverse flow of refrigerant and reducing flow noise. The scroll compressor efficiently distribute refrigerant suctioned into the scroll compressor to a compression chamber and a drive unit. The scroll compressor includes a main body, a fixed scroll fixedly installed in the main body, an orbiting scroll configured to engage with the fixed scroll and perform a relative orbiting motion, and to form a compression chamber with the fixed scroll, a partition plate disposed above the fixed scroll to separate an inside of the main body into a low-pressure portion and a high-pressure portion, a first check valve installed at a discharge port of the fixed scroll to open and close the discharge port, and a second check valve installed on the partition plate to open and close an opening allowing communication between the low-pressure portion and the high-pressure portion.

9 Claims, 12 Drawing Sheets

(51) Int. Cl.

| | |
|---|---|
| ***F04C 27/00*** | (2006.01) |
| ***F04C 28/06*** | (2006.01) |
| ***F04C 23/00*** | (2006.01) |
| ***F04C 29/12*** | (2006.01) |

(52) U.S. Cl.
CPC ..... *F04C 18/0261* (2013.01); *F04C 23/008* (2013.01); *F04C 27/005* (2013.01); *F04C 27/008* (2013.01); *F04C 28/06* (2013.01); *F04C 29/126* (2013.01)

(58) Field of Classification Search
CPC ..... F01C 1/0207–0223; F01C 1/0253; F01C 1/0261
See application file for complete search history.

(56) References Cited

U.S. PATENT DOCUMENTS 6,227,830 B1 * 5/2001 Fields ..... F04C 29/126 137/533.17
6,457,952 B1 * 10/2002 Haller ..... F04C 29/126 137/533.27
2015/0176585 A1 6/2015 Sun
2015/0369246 A1 * 12/2015 Kim ..... F04C 28/10 418/55.1
2017/0045049 A1 2/2017 Park et al.
2017/0306957 A1 * 10/2017 Lee ..... F04C 27/008

FOREIGN PATENT DOCUMENTS

JP 2003172275 A * 6/2003 ..... F04C 29/126
JP 2009-287512 12/2009
JP 2009287512 A * 12/2009 ..... F04C 23/008
JP 2010-48217 3/2010
KR 1999-0035952 5/1999
KR 2000-0043836 7/2000
KR 10-2017-0019098 2/2017
WO WO-2015068328 A1 * 5/2015 ..... F04C 23/008

OTHER PUBLICATIONS

Chinese Office Action dated May 8, 2021 in Chinese Patent Application No. 201880056798.8.

* cited by examiner

SCROLL COMPRESSOR WITH IMPROVED VALVE INSTALLATION

CROSS-REFERENCE TO RELATED APPLICATIONS

This application is a U.S. National Stage Application which claims the benefit under 35 U.S.C. § 371 of International Patent Application No. PCT/KR2018/010004 filed on Aug. 29, 2018, which claims foreign priority benefit under 35 U.S.C. § 119 of Korean Patent Application No. 10-2017-0111664 filed on Sep. 1, 2017, in the Korean Intellectual Property Office, the contents of all of which are incorporated herein by reference.

TECHNICAL FIELD

The present disclosure relates to a scroll compressor.

BACKGROUND ART

Generally, a compressor is a machine that receives power from an electric motor or a turbine or other power generating device to compress air, refrigerant or various other operating gases to increase the pressure. It is widely used in household appliances such as refrigerators and air conditioners or throughout the industry.

The compressor includes a reciprocating compressor in which a compression space, in which a working gas is sucked and discharged between a piston and a cylinder, is formed and the piston reciprocates linearly in the cylinder to compress the refrigerant, a rotary compressor in which a compression space in which a working gas is sucked and discharged between a rolling piston that rotates eccentrically and a cylinder is formed and the rolling piston eccentrically rotates along the inner wall of the cylinder to compress the refrigerant, and a scroll-type compressor in which a compression space in which a working gas is sucked and discharged between an orbiting scroll and a fixed scroll is formed and the orbiting scroll rotates along the fixed scroll to compress the refrigerant.

A scroll compressor is a device for compressing a refrigerant by relative movements between fixed and orbiting scrolls each having a spiral wrap.

The scroll compressor is widely used in refrigeration cycle devices because it has a higher efficiency, lower vibration and noise, smaller size, and lighter weight than reciprocating compressors or rotary compressors.

The scroll compressor may include a fixed scroll accommodated in a hermetic container, an orbiting scroll rotating with respect to the fixed scroll, and a high/low pressure separating plate installed above the fixed scroll inside the hermetic container to divide the interior of the hermetic container into a high-pressure portion and a low-pressure portion.

The refrigerant sucked into the hermetic container may be introduced into a compression chamber and compressed, and then discharged to the outside of the hermetic container.

A check valve is provided in the hermetic container to prevent a reverse flow during the movement of the refrigerant. Since an effect of the check valve depends on an installation position of the check valve, it is necessary to appropriately determine the installation position of the check valve.

DISCLOSURE

Technical Problem

It is an aspect of the present disclosure to provide a scroll compressor capable of preventing reverse flow of refrigerant and reducing flow noise while the scroll compressor is stopped, by having a proper installation position of a check valve.

It is another aspect of the present disclosure to be capable of efficiently distributing and transferring refrigerant sucked into the scroll compressor, to a compression chamber and a drive unit.

Technical Solution

In accordance with an aspect of the present disclosure, a scroll compressor includes a main body, a fixed scroll fixedly installed in the main body, an orbiting scroll configured to engage with the fixed scroll and perform a relative orbiting motion, and to form a compression chamber with the fixed scroll, a partition plate disposed above the fixed scroll to separate an inside of the main body into a low-pressure portion and a high-pressure portion, a first check valve installed at a discharge port of the fixed scroll to open and close the discharge port, and a second check valve installed on the partition plate to open and close an opening allowing communication between the low-pressure portion and the high-pressure portion.

A volume of a space where a high pressure is formed between the first check valve and the second check valve during operation of the scroll compressor may be 20% to 200% of a total suction volume.

The first check valve may move in a vertical direction along a plurality of guides to open and close the discharge port, and the second check valve may move in the vertical direction along a plurality of guides to open and close the opening.

The first check valve and the second check valve may include a steel plate having a thickness of 1 mm or less.

A valve seat member for mounting the second check valve may be attached to the partition plate and the valve seat member may be attached to the partition plate by a projection welding.

A back pressure chamber may be formed between the fixed scroll and the partition plate, and the back pressure chamber may be formed by a discharge guide provided on the fixed scroll and a back pressure actuator installed on the discharge guide to be movable in a vertical direction.

A hardness of the valve seat member may be higher than a hardness of the back pressure actuator.

During operation of the scroll compressor, the back pressure actuator may move upward so as to be in close contact with a lower portion of the valve seat member by a high pressure of the back pressure chamber such that the inside of the main body is separated into the high-pressure portion and the low-pressure portion. While the scroll compressor is stopped, the back pressure actuator may move downward to be separated from the valve seat member by a low pressure of the back pressure chamber such that a pressure difference is relieved inside the main body.

The scroll compressor may further include a sealing member disposed to seal a gap between the discharge guide and the back pressure actuator to seal the back pressure chamber. The sealing member may be provided in a ring shape having a rectangular cross section.

The sealing member may have a cutout portion that is partially cut so as to allow the sealing member to be movable in the vertical direction, and the cutout portion may have an inclined surface.

While the scroll compressor is stopped, the sealing member may be moved upward by a high pressure of the back pressure chamber such that refrigerant in the back pressure chamber flows out of the back pressure chamber through the gap.

A ring-shaped wave spring may be disposed on the sealing member to move the sealing member which is moved upward downward to seal the gap.

While the scroll compressor is stopped, the first check valve closes the discharge port to prevent a reverse rotation in which high pressure refrigerant discharged through the discharge port from flows back into the discharge port and the second check valve closes the opening to prevent the refrigerant in the high-pressure portion from moving to the low-pressure portion.

Advantageous Effects

In accordance with embodiments of the present disclosure, it may be possible to prevent reverse flow of the refrigerant and reduce flow noise while the scroll compressor is stopped.

The refrigerant suctioned into the scroll compressor may be directly transferred to the compression chamber to prevent the temperature rise of the refrigerant, thereby improving the performance of the scroll compressor due to an increase in volume efficiency.

It may also be possible to reduce the flow noise and improve the performance of the drive unit through efficient distribution of the refrigerant suctioned into the scroll compressor.

MODE FOR INVENTION

Figure 1:
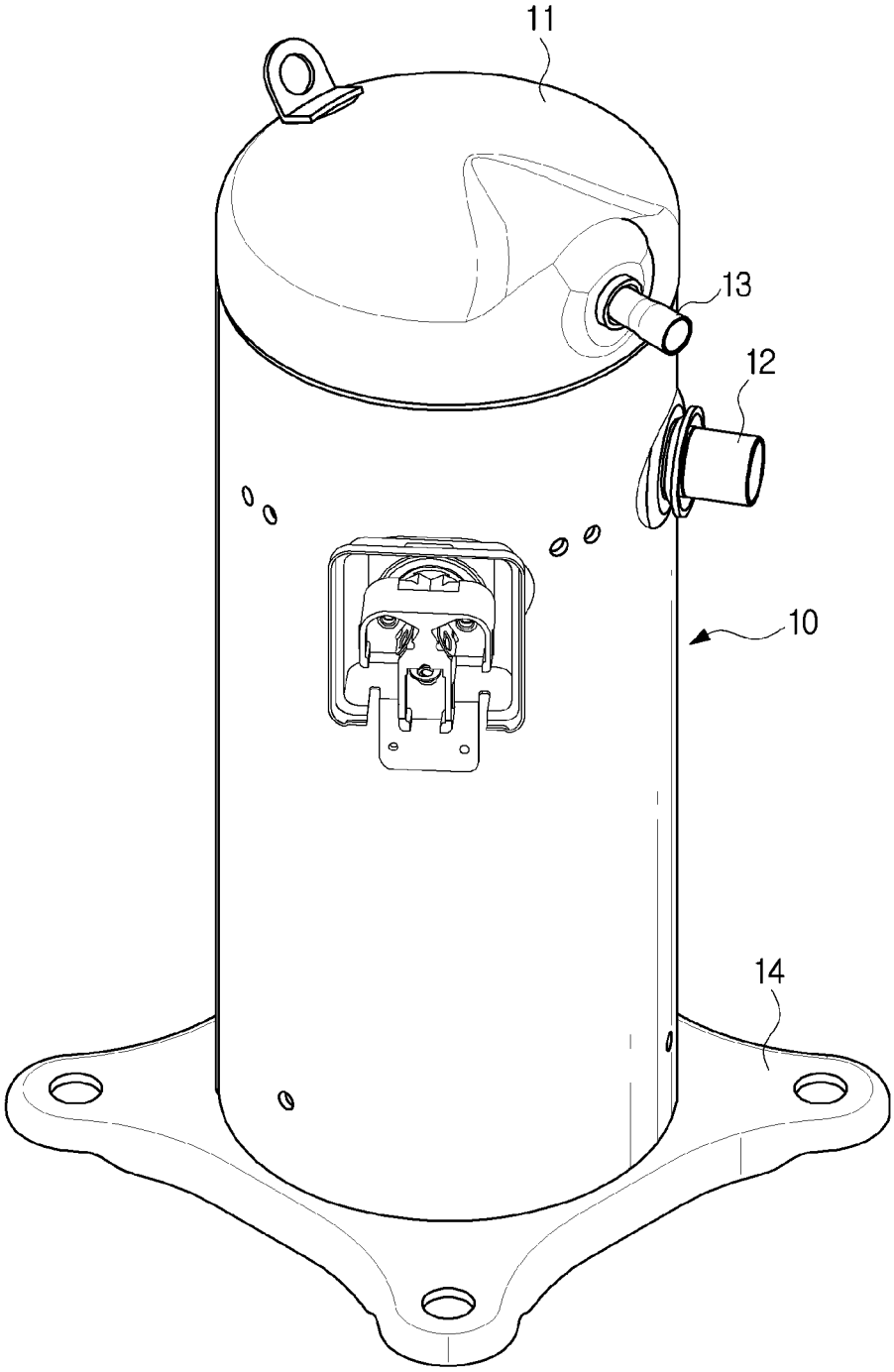
FIG. 1 is a perspective view illustrating a scroll compressor according to a first embodiment of the present disclosure.

Configurations illustrated in the embodiments and the drawings described in the present specification are only the appropriate embodiments of the present disclosure, and thus it is to be understood that various modified examples, which may replace the embodiments and the drawings described in the present specification, are possible when filing the present application.

Also, like reference numerals or symbols denoted in the drawings of the present specification indicate elements or components that perform the substantially same functions.

Also, the terms used in the present specification are for describing embodiments and not for limiting or restricting the present disclosure. It is to be understood that the singular forms "a," "an," and "the" include plural referents unless the context clearly dictates otherwise. It will be understood that the terms "includes," "comprises," "including," and/or "comprising," when used in this specification, specify the presence of stated features, figures, steps, components, or combination thereof. Therefore, they do not preclude the presence or addition of one or more other features, figures, steps, components, members, or combinations thereof.

It will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

The terms "front end", "rear end", "upper portion", "lower portion", "upper end" and "lower end" used in the following description are defined based on the drawings. The shape and position of each component should not be limited by these terms.

Hereinafter, exemplary embodiments according to the present disclosure will be described in detail with reference to the accompanying drawings.

Figure 2:
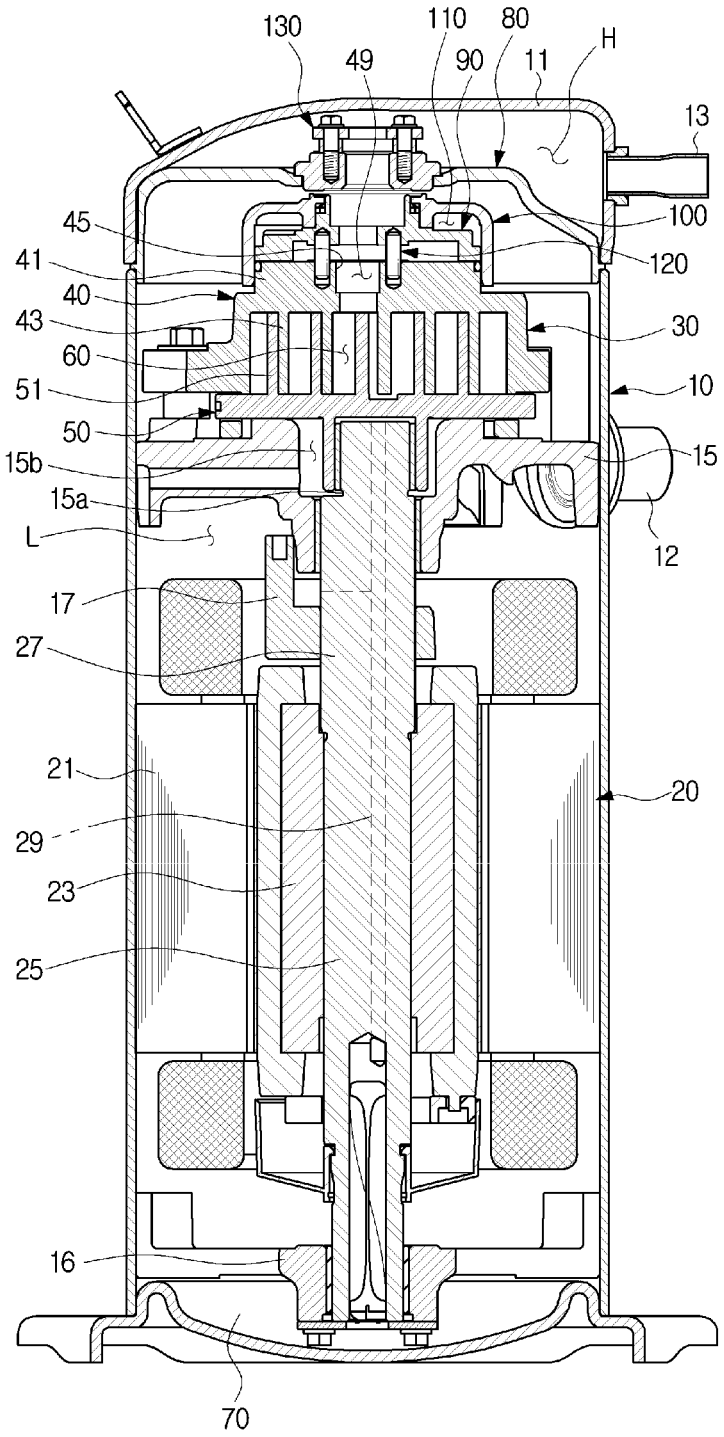
FIG. 2 is a cross-sectional view illustrating the scroll compressor according to the first embodiment of the present disclosure.
Figure 3:
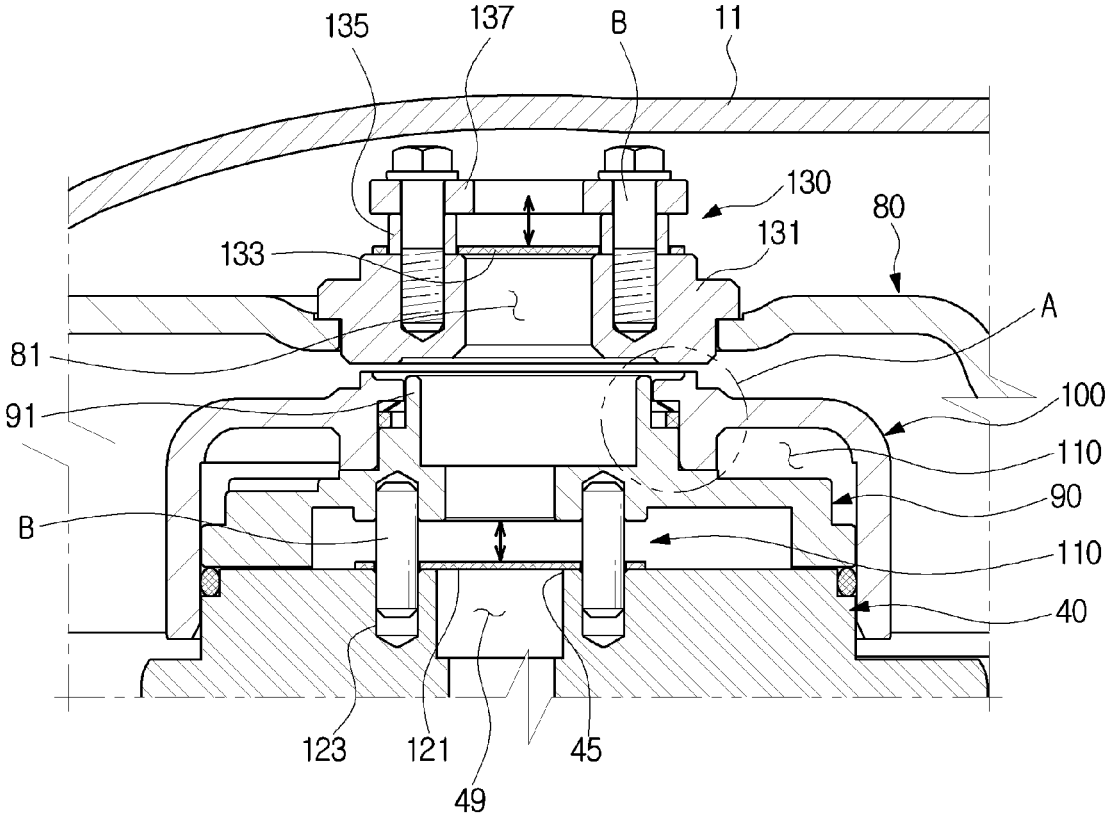
FIG. 3 is an enlarged cross-sectional view illustrating a part of the scroll compressor according to the first embodiment of the present disclosure

FIG. 1 is a perspective view illustrating a scroll compressor according to a first embodiment of the present disclosure, FIG. 2 is a cross-sectional view illustrating the scroll compressor according to the first embodiment of the present disclosure, and FIG. 3 is an enlarged cross-sectional view illustrating a part of the scroll compressor according to the first embodiment of the present disclosure.

As illustrated in FIGS. 1 to 3, a scroll compressor may include a main body 10 having a closed inner space, and a drive unit 20 and a compression unit 30 disposed in the main body 10.

The main body 10 may include an upper cap 11 mounted on an upper portion of the main body 10 to seal the main body 10, a suction pipe 12 provided to allow refrigerant to flow into the main body 10, a discharge pipe 13 provided to discharge the refrigerant, which is suctioned through the suction pipe 12 and compressed, to the outside of the main body 10, and a bottom plate 14 provided on a bottom of the main body 10 to support the main body 10.

An upper flange 15 and a lower flange 16 may be respectively fixed to an inner upper part and an inner lower part of the main body 10. The drive unit 20 may be disposed between the upper flange 15 and the lower flange 16.

The drive unit 20 may include a stator 21 press-fitted into the lower part of the main body 10, and a rotor 23 rotatably installed at the center of the stator 21, and a rotation shaft 25 to transmit a rotational force of the rotor 23 to the compression unit 30.

A balance weight 17 may be mounted to each of upper and lower portions of the rotor 23 to adjust unbalanced rotation of the rotor 23 during rotation of the rotor 23.

The rotation shaft 25 may be disposed between the upper flange 15 and the lower flange 16 to transmit a rotational force generated from the drive unit 20 to an orbiting scroll 50 of the compression unit 30.

An eccentric portion 27 eccentrically spaced from the center point of the rotation shaft 25 may be disposed at an upper end of the rotation shaft 25.

A through-hole 15*a* through which the rotation shaft 25 passes may be disposed at the center of the upper flange 15. An oil storage portion 15*b* configured to accommodate oil suctioned through the rotation shaft 25 may be formed in the vicinity of the through-hole 15*a*.

An oil flow path 29 may be formed in the rotation shaft 25 in an axial direction of the rotation shaft 25, and an oil pump (not shown) may be mounted to a lower end of the oil flow path 29.

An oil storage space 70 may be located at an inner bottom surface of the main body 10.

A lower end of the rotation shaft 25 may extend to the region of oil stored in the oil storage space 70 such that oil stored in the oil storage space 70 moves upward through the oil flow path 29 formed in the axial direction of the rotation shaft 25.

Oil stored in the oil storage space 70 may be pumped by an oil pump (not shown) mounted to the lower end of the rotation shaft 25 such that the oil may move to the upper end of the rotation shaft 25 along the oil flow path 29 formed in the rotation shaft 25 and may thus arrive at the compression unit 30.

The compression unit 30 may include a fixed scroll 40 provided on an upper portion of the drive unit 20 and fixedly installed in the main body 10, and an orbiting scroll 50 engaged with the fixed scroll 40 to perform a relative orbiting motion.

The fixed scroll 40 may be fixedly installed in the main body 10 so as to be positioned above the upper flange 15. The fixed scroll 40 may include a body 41, a fixed wrap 43 provided to have a predetermined thickness and height within the body 41, a discharge port 45 formed to pass through a center of the body 41, an inlet port 47 formed at one side of the body 41, and a discharge flow path 49 for communicating the compression chamber 60 and the discharge port 45.

As for the fixed scroll 40, the fixed wrap 43 may engage with an orbiting wrap 51 of the orbiting scroll 50 located under the fixed scroll 40 to form the compression chamber 60.

The orbiting scroll 50 may be positioned between the fixed scroll 40 and the upper flange 15 to perform an orbiting movement relative to the fixed scroll.

The rotation shaft 25 is fitted in the orbiting scroll 50 such that the orbiting scroll 50 is operated by the rotation shaft 25. The orbiting scroll 50 may include a spiral-shaped orbiting wrap 51 on an upper surface thereof.

The compression chamber 60 is formed by the fixed scroll 40 and the orbiting scroll 50. The refrigerant suctioned into the compression chamber 60 is moved to the center of the compression chamber 60 by a continuous swirling motion of the orbiting scroll 50, and the volume thereof is reduced and compressed.

The refrigerant suctioned into the main body 10 through the suction pipe 12 may flow into the compression chamber 60 through the inlet port 47 of the fixed scroll 40. The refrigerant introduced into the compression chamber 60 may be compressed and then discharged to the outside of the fixed scroll 40 through the discharge flow path 49 and the discharge port 45.

A partition plate 80 for separating the inside of the main body 10 into a high-pressure portion H and a low-pressure portion L is installed over the fixed scroll 40, and an upper portion and an lower portion inside the main body 10 divided by the partition plate 80 correspond to the high-pressure portion H and the low-pressure portion L, respectively.

The refrigerant compressed in the compression chamber 60 is discharged through the discharge port 45 of the fixed scroll 40 and flows to the partition plate 80. The partition plate 80 may be provided with an opening 81 through which the refrigerant discharged through the discharge port 45 of the fixed scroll 40 passes.

Therefore, the refrigerant suctioned into the main body 10 through the suction pipe 12 may be primarily introduced into the low-pressure portion L, and the high-pressure refrigerant compressed in the compression chamber 60 may be introduced into the high-pressure portion H through the opening 81 of the partition plate 80.

The refrigerant flowing through the low-pressure portion L may cool the compression unit 30 and the drive unit 20 while flowing outside the compression unit 30 and the drive unit 20. The high-pressure refrigerant having passed through the compression chamber 60 may flow into the high-pressure portion H provided between the upper cap 11 and the partition plate 80 and then be discharged to the outside of the main body 10 by the discharge pipe 13.

A discharge guide 90 may be provided on the fixed scroll 40 so as to be positioned between the fixed scroll 40 and the partition plate 80. A discharge guide portion 91 may be provided at a center portion of the discharge guide 90. The discharge guide portion 91 is opened such that the refrigerant discharged through the discharge port 45 of the fixed scroll 40 may flow to the partition plate 80 through the discharge guide 90.

A back pressure actuator 100 may be provided on the discharge guide 90 so as to be positioned between the discharge guide 90 and the partition plate 80.

The back pressure actuator 100 may be configured to form a back pressure chamber 110 between the back pressure actuator 100 and the discharge guide 90 and move in a vertical direction by a pressure of the refrigerant in the back pressure chamber 110.

During operation of the scroll compressor, the refrigerant suctioned into the main body 10 through the suction pipe 12 is introduced into the low-pressure portion L, a part of the introduced refrigerant flows into the compression chamber 60, and a remaining part of the introduced refrigerant may be transferred to the drive unit 20.

The part of the refrigerant flowing into the compression chamber 60 may be introduced into the back pressure chamber 110 and the refrigerant flowing into the back pressure chamber 110 may press and move the back pressure actuator 100 upward.

When the back pressure actuator 100 is moved upward and brought into close contact with a lower portion of a valve seat member 131 of a second check valve unit 130 to be described later, the discharge port 45 of the fixed scroll 40 may be communicated with the opening 81 of the partition plate 80 by the discharge guide portion 91 of the discharge guide 90.

The inside of the main body 10 may be divided into the high-pressure portion H at the upper portion thereof and a low-pressure portion L at the lower portion of thereof by the partition plate 80.

The high-pressure refrigerant compressed in the compression chamber 60 is discharged to the outside of the compression chamber 60 through the discharge port 45 of the fixed scroll 40. The refrigerant discharged to the outside of the compression chamber 60 may flow to the high-pressure portion H through the opening 81 of the partition plate 80.

When the operation of the scroll compressor is completed, the refrigerant in the compression chamber 60 and the back pressure chamber 110 is discharged through the discharge port 45 of the fixed scroll 40, and the pressure of the back pressure chamber 110 is reduced to allow the back pressure actuator to slide downward.

As a result, the partition plate 80 and the back pressure actuator 100 are separated from each other, the boundary between the high-pressure portion H and the low-pressure portion L is eliminated, and the pressure difference inside the main body 10 may be relieved.

When the pressure difference inside the main body 10 is relieved, the operation of the orbiting scroll 50 is ended and the scroll compressor is stopped.

A first check valve unit 120 may be installed at the discharge port 45 of the fixed scroll 40 and a second check valve unit 130 may be installed on the partition plate 80 to prevent the refrigerant from flowing backward when the scroll compressor is stopped.

The first check valve unit 120 may be installed at the discharge port 45 of the fixed scroll 40 to open and close the discharge port 45.

The first check valve unit 120 may include a first check valve 121 configured to move in a vertical direction to open and close the discharge port 45, and a plurality of guides 123 configured to guide the first check valve 121 to move up and down. The first check valve unit 120 may be coupled to the fixed scroll 40 by a fastening member B such as a bolt.

Although two guides 123 are shown in the drawings, the present disclosure is not limited thereto.

The first check valve 121 may be formed of a steel plate having a thickness of 1 mm or less and moved upward along the plurality of guides 123 during operation of the scroll compressor to open the discharge port 45 of the fixed scroll 40. The refrigerant compressed in the compression chamber 60 may be moved to the high-pressure portion H through the discharge port 45 and then discharged to the outside of the main body 10 through the discharge pipe 13.

The first check valve 121 may be moved downward along the plurality of guides 123 by the high pressure refrigerant on the fixed scroll 40 the fixed scroll 40 to close the discharge port 45 of the fixed scroll 40 when the scroll compressor is stopped.

As a result, when the scroll compressor is stopped, the pressure difference between the compression chamber 60 and the discharge port 45 is reduced to prevent the refrigerant of high temperature and high pressure from flowing back to the compression chamber 60 through the discharge port 45.

Figure 4:
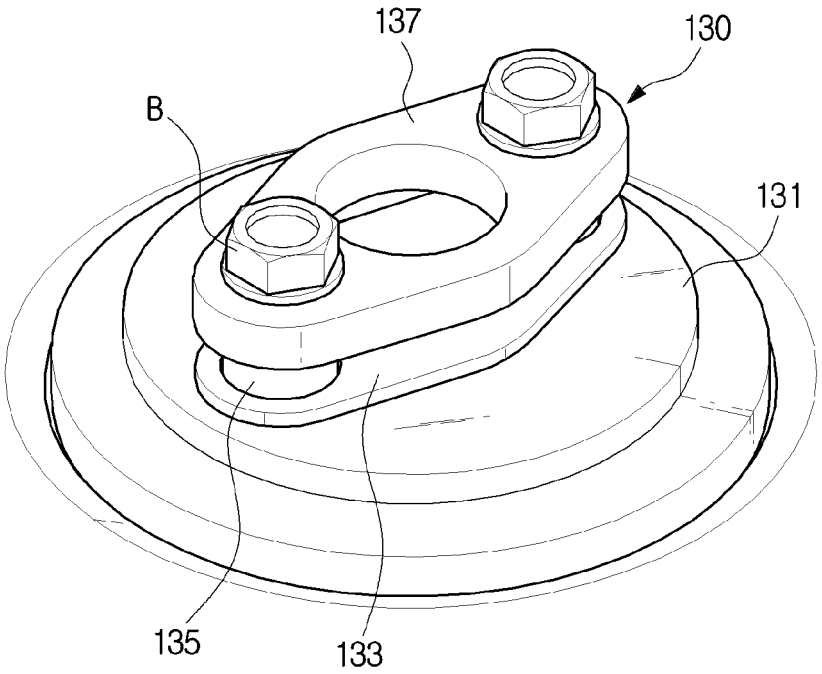
FIG. 4 is a view illustrating a second check valve of the scroll compressor according to the first embodiment of the present disclosure.

FIG. 4 is a view illustrating a second check valve of the scroll compressor according to the first embodiment of the present disclosure.

As illustrated in FIGS. 3 and 4, the second check valve unit 130 is installed on the partition plate 80 to open and close the opening 81.

The second check valve unit 130 may include a valve seat member 131 attached to the partition plate 80 for mounting a second check valve 133 on the partition plate 80, the second check valve 133 configured to move in the vertical direction to open and close the opening 81, a plurality of guides 135 for guiding the vertical movement of the second check valve 133, and a stopper 137 to restrict the vertical movement of the second check valve 133. The second check valve 133 may be coupled to the valve seat member 131 by a fastening member B such as a bolt or the like.

The valve seat member 131 may be attached to the partition plate 80 by a projection welding and appropriately, have a hardness higher than a hardness of the back pressure actuator 100.

Although two guides 135 are shown in the drawings, the present disclosure is not limited thereto.

The second check valve 133 may be formed of a steel plate having a thickness of 1 mm or less and moved upward along the plurality of guides 135 during operation of the scroll compressor to open the opening 81 of the partition plate 80. The refrigerant discharged through the discharge port 45 of the fixed scroll 40 may be moved to the high-pressure portion H through the opening 81 and then discharged to the outside of the main body 10 through the discharge pipe 13.

The second check valve 133 may be moved downward along the plurality of guides 135 by the high pressure refrigerant in the high-pressure portion H to close the opening 81 of the partition plate 80 when the scroll compressor is stopped.

Accordingly, it is possible to prevent the refrigerant from flowing backward from the high-pressure portion (H) to the low-pressure portion (L) when the scroll compressor is stopped, thereby reducing the flow noise.

During the operation of the scroll compressor, a high pressure is formed in the space between the first check valve unit 120 and the second check valve unit 130, and a volume of the portion where the high pressure is formed may be 20 to 200% of a total suction volume.

Under the above conditions, the noise of the scroll compressor can be reduced while the compressor is stopped, and the restart operation can be facilitated.

Since the second check valve 133 is not installed directly on the partition plate 80 but the valve seat member 131 for mounting the second check valve 133 is attached to the partition plate 80 such that the second check valve 133 is installed on the valve seat member 131, leakage due to the second check valve 133 can be minimized.

Since it is possible to minimize the leakage of the refrigerant caused by the second check valve 133, it may take a long time to reach a state in which there is no pressure difference in the inside of the main body 10 while the scroll compressor is stopped, and thus it may be possible to increase energy efficiency by additionally using the pressure of the refrigerant remaining in the main body 10.

Figure 5:
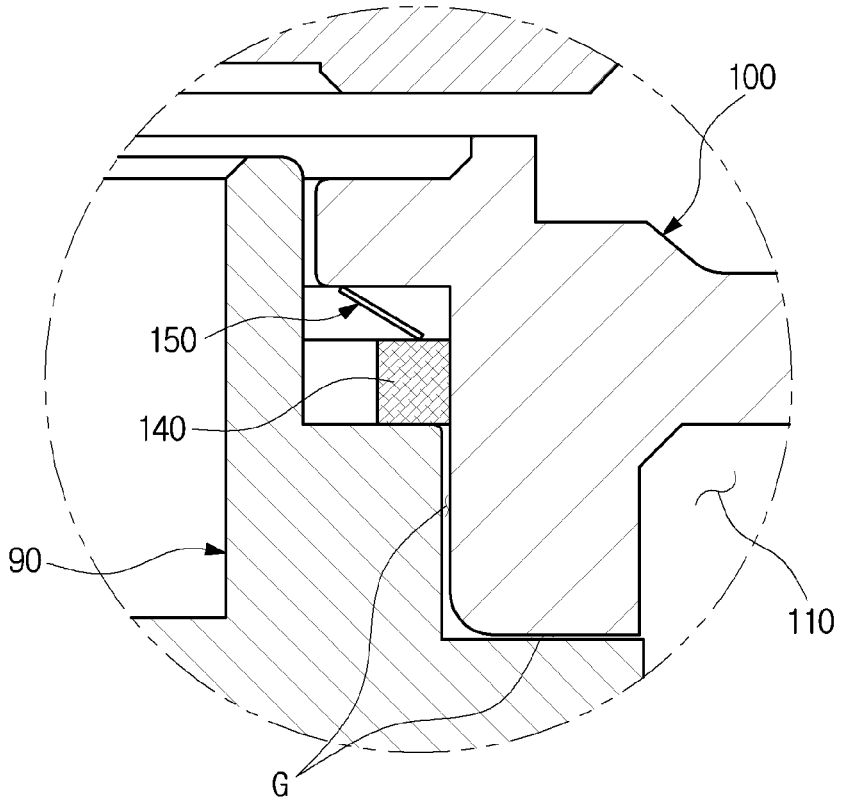
FIG. 5 is an enlarged view illustrating a portion A in FIG. 3, in which a sealing member seals a gap between a discharge guide and a back pressure actuator.
Figure 6:
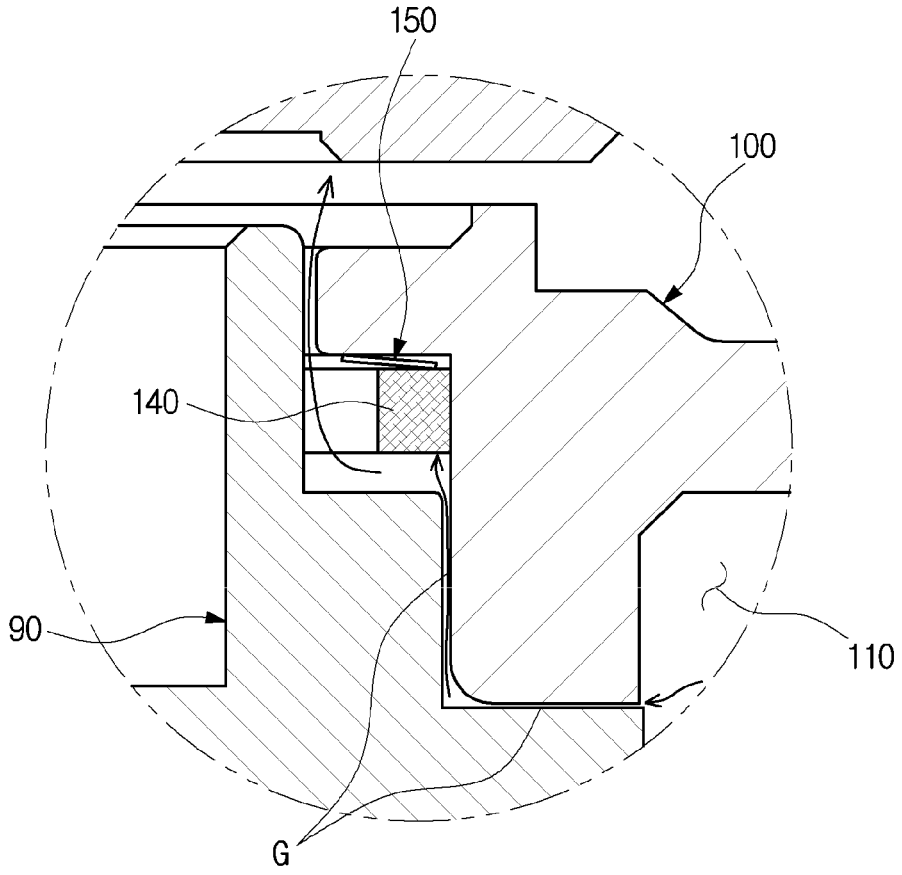
FIG. 6 is a view illustrating a state in which the sealing member shown in FIG. 5 is moved upward and refrigerant in a back pressure chamber is discharged through the gap between the discharge guide and the back pressure actuator.
Figure 7:
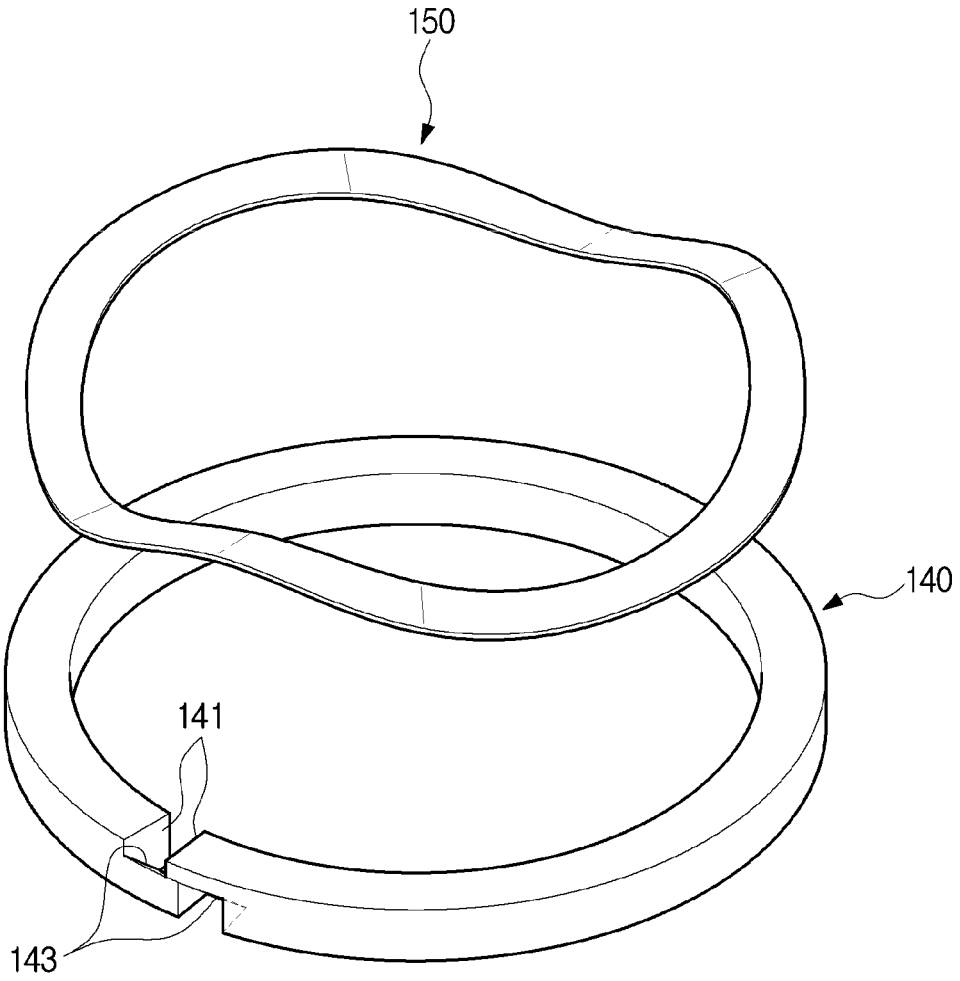
FIG. 7 is a view illustrating the sealing member and a wave spring of the scroll compressor according to the first embodiment of the present disclosure.

FIG. 5 is an enlarged view illustrating a portion A in FIG. 3, in which a sealing member seals a gap between a discharge guide and a back pressure actuator, FIG. 6 is a view illustrating a state in which the sealing member shown in FIG. 5 is moved upward and refrigerant in a back pressure chamber is discharged through the gap between the discharge guide and the back pressure actuator, and FIG. 7 is a view illustrating the sealing member and a wave spring of the scroll compressor according to the first embodiment of the present disclosure.

As illustrated in FIGS. 5 to 7, the back pressure chamber 110 formed by the discharge guide 90 and the back pressure actuator 100 may be sealed by a sealing member 140 (See FIG. 3). The sealing member 140 is provided between the discharge guide 90 and the back pressure actuator 100 to seal a gap G between the discharge guide 90 and the back pressure actuator 100.

The sealing member 140 may be formed in a ring shape having a rectangular cross section and may include a cutout portion 141 partially cut so as to allow the sealing member to be movable upward and downward. The cutout portion 141 may include an inclined surface 143.

During operation of the scroll compressor, the sealing member 140 may seal the gap G between the discharge guide 90 and the back pressure actuator 100 to prevent the refrigerant in the back pressure chamber 110 from flowing out.

The sealing member 140 may be moved upward by the high pressure in the back pressure chamber 110 so that the refrigerant in the back pressure chamber 110 flows out of the back pressure chamber 110 through the gap G between the discharge guide 90 and the back pressure actuator 100.

While the refrigerant in the back pressure chamber 110 flows out, pressure balancing is performed in the compressor, which is advantageous for restarting the scroll compressor.

A wave spring 150 is installed on the sealing member 140 to prevent the sealing member 140 from being not moved downward due to viscosity of oil when the sealing member 140 is moved upward and in close contact with the back pressure actuator 100.

Figure 8:
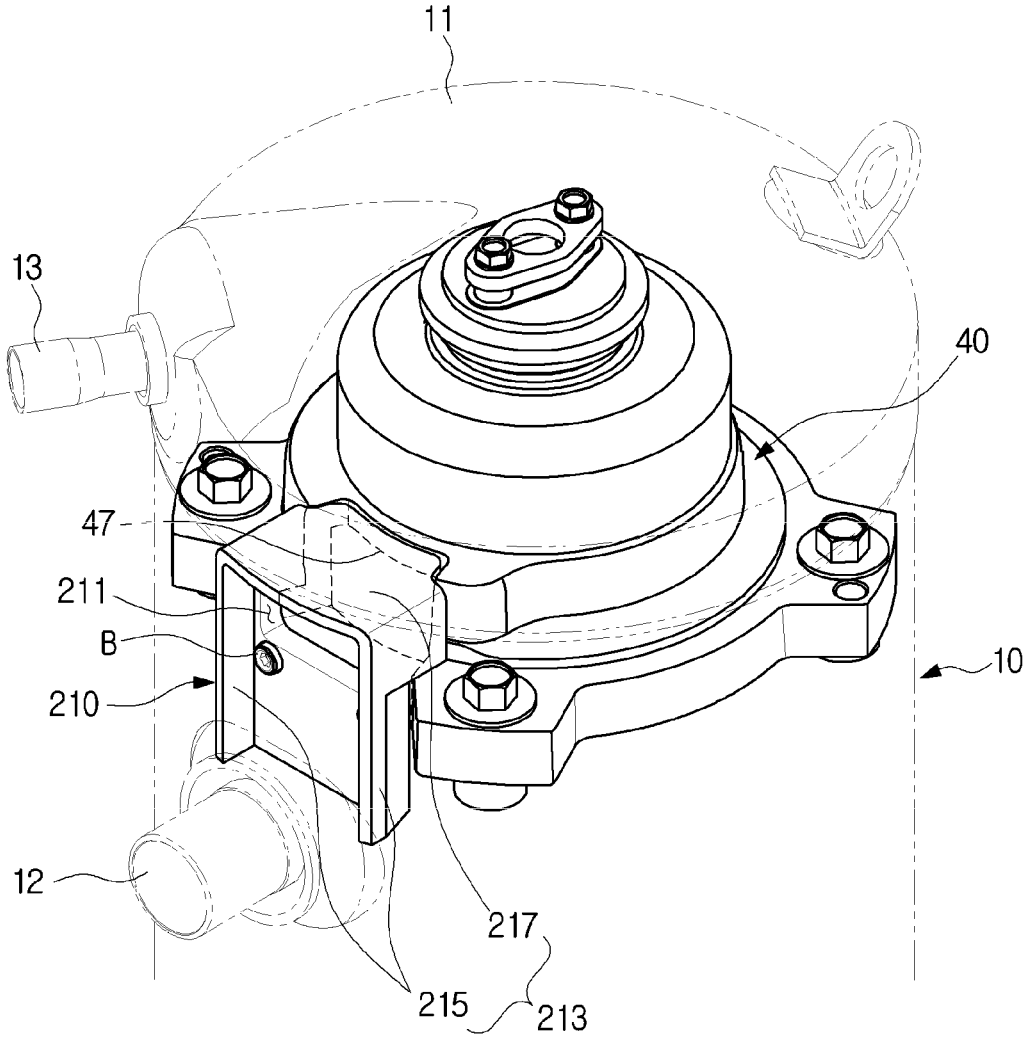
FIG. 8 is a view illustrating a refrigerant distribution unit installed on a fixed scroll in the scroll compressor according to the first embodiment of the present disclosure.
Figure 9:
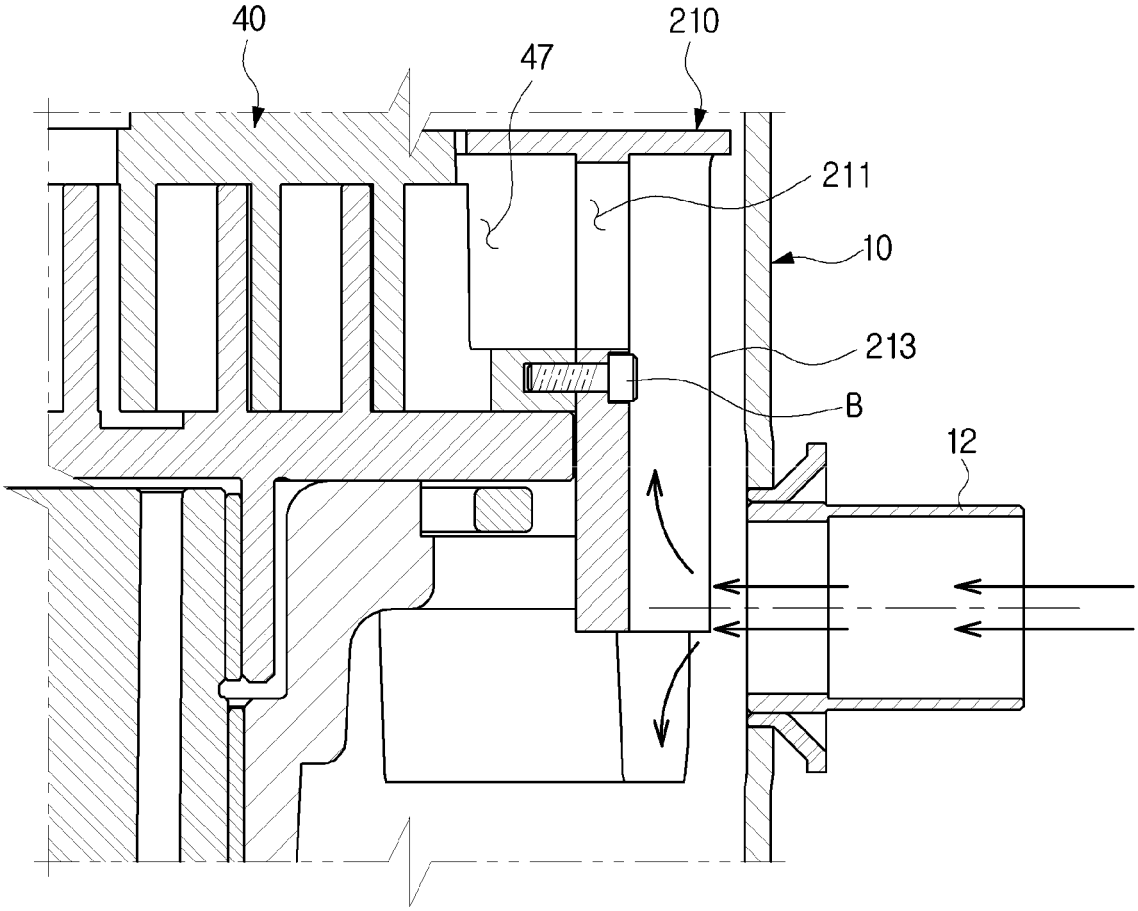
FIG. 9 is a view illustrating a state in which refrigerant suctioned into a main body is distributed and transferred by the refrigerant distribution unit of the scroll compressor according to the first embodiment of the present disclosure.

FIG. 8 is a view illustrating a refrigerant distribution unit installed at a fixed scroll in the scroll compressor according to the first embodiment of the present disclosure, and FIG. 9 is a view illustrating a state in which refrigerant suctioned into a main body is distributed and transferred by the refrigerant distribution unit of the scroll compressor according to the first embodiment of the present disclosure.

As illustrated in FIGS. 8 and 9, a refrigerant distribution unit 210 may be installed at the fixed scroll 40 for efficient distribution of the refrigerant suctioned through the suction pipe 12.

Although the suction refrigerant distribution unit 210 is installed at the fixed scroll 40 in the drawings, the present disclosure is not limited thereto.

Since the compression chamber 60 is located above the suction pipe 12, the refrigerant distribution unit 210 may be provided above the suction pipe 12 (See FIG. 2).

However, the position of the refrigerant distribution unit 210 may vary depending on the position of the suction pipe 12.

The refrigerant distribution unit 210 may include a communication port 211 communicating with the inlet port 47 of the fixed scroll 40 so as to communicate with the compression chamber 60 and a guide portion 213 to guide a part of the refrigerant suctioned through the suction pipe 12 to the communication port 211 (See FIG. 2).

The guide portion 213 for guiding the refrigerant to the communication port 211 may have opposite side walls 215 and an upper wall 217 to prevent the refrigerant in the main body 10 from flowing thereinto. This is to increase volume efficiency by blocking the temperature rise of the refrigerant while the refrigerant suctioned through the suction pipe 12 is transferred to the compression chamber 60 (See FIG. 2).

The refrigerant distribution unit 210 is configured such that about 51~75% of the refrigerant suctioned through the suction pipe 12 is directly transferred to the compression chamber 60 through the communication port 211, and about 25~49% of the refrigerant suctioned through the suction pipe 12 is transferred to the drive unit 20 for cooling the drive unit 20.

For this purpose, it may be appropriate that a lower end of the guide portion 213 is positioned lower than a center of an inner diameter of the suction pipe 12.

When the lower end of the guide portion 213 is positioned lower than the center of the inner diameter of the suction pipe 12, a large amount of refrigerant in the refrigerant suctioned through the suction pipe 12 may be guided upward along the guide portion 213 and transferred to the compression chamber 60 through the communication port 211, and a small amount of refrigerant may be transferred to the drive unit 20 (See FIG. 2).

Figure 10:
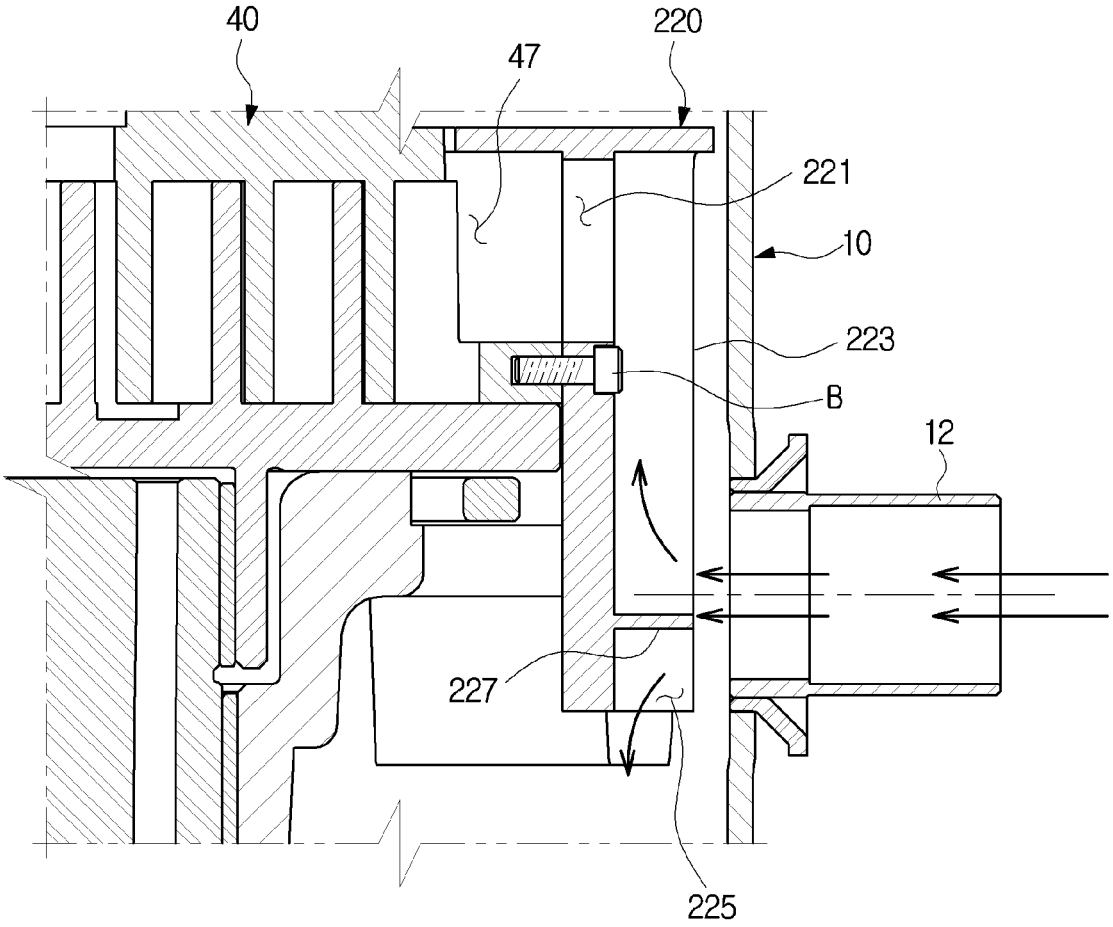
FIG. 10 is a view illustrating a state in which refrigerant suctioned into a main body is distributed and transferred by a refrigerant distribution unit of a scroll compressor according to a second embodiment of the present disclosure.
Figure 11:
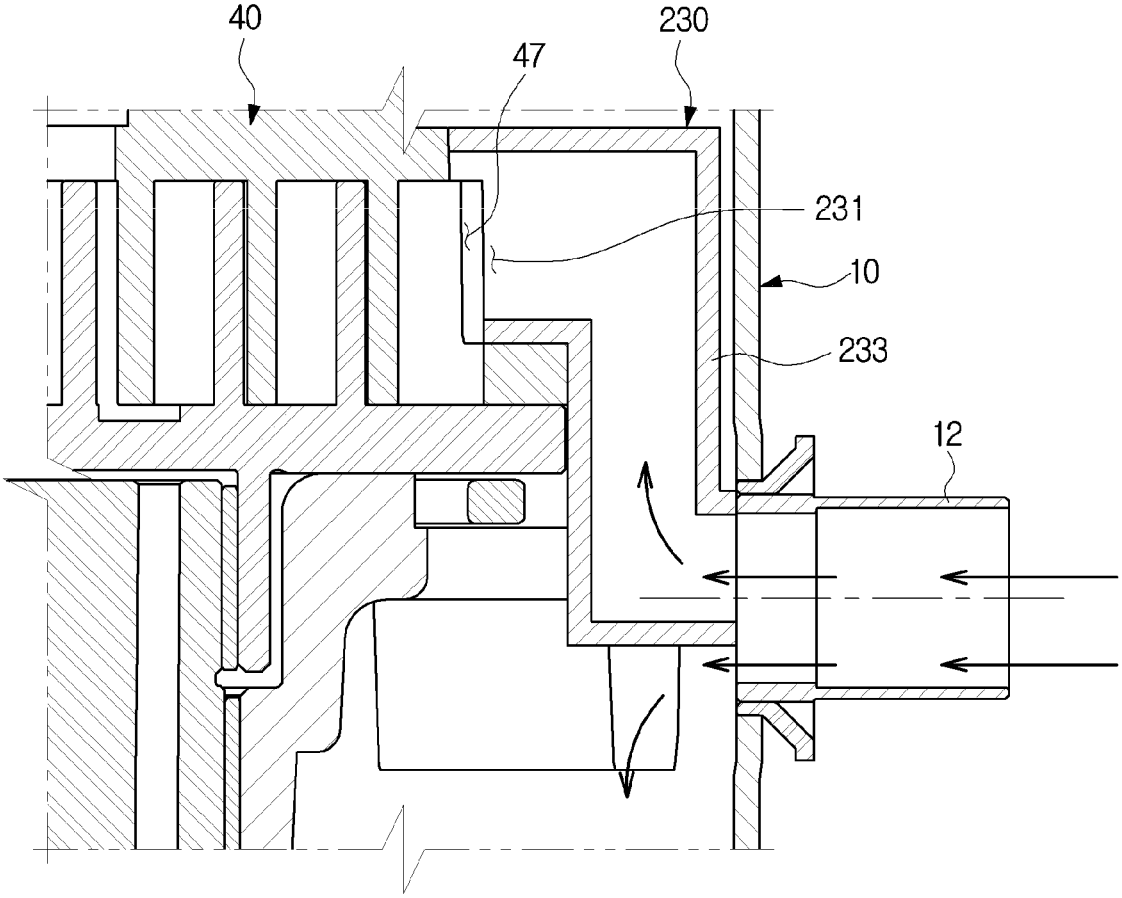
FIG. 11 is a view illustrating a state in which refrigerant suctioned into a main body is distributed and transferred by a refrigerant distribution unit of a scroll compressor according to a third embodiment of the present disclosure.
Figure 12:
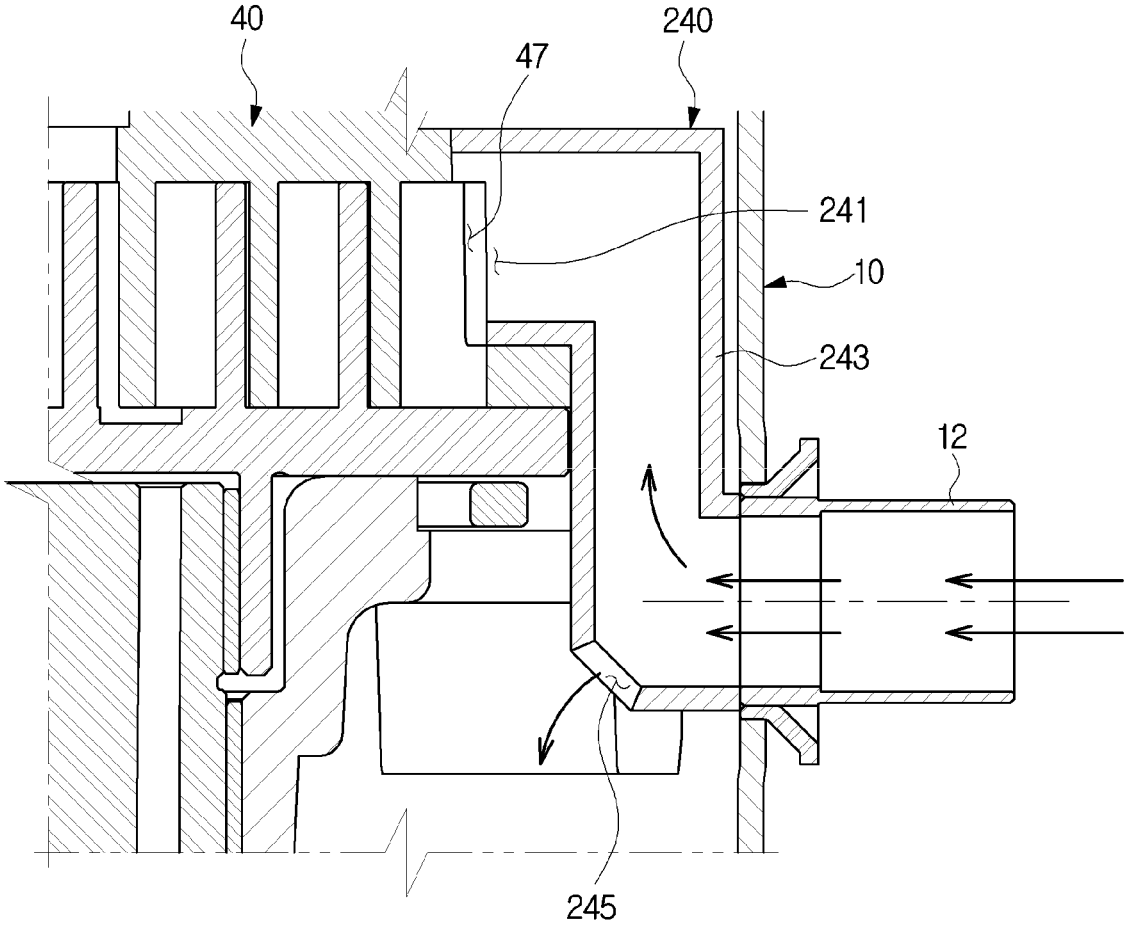
FIG. 12 is a view illustrating a state in which refrigerant suctioned into a main body is distributed and transferred by a refrigerant distribution unit of a scroll compressor according to a fourth embodiment of the present disclosure.

FIG. 10 is a view illustrating a state in which refrigerant suctioned into a main body is distributed and transferred by a refrigerant distribution unit of a scroll compressor according to a second embodiment of the present disclosure, FIG. 11 is a view illustrating a state in which refrigerant suctioned into a main body is distributed and transferred by a refrigerant distribution unit of a scroll compressor according to a third embodiment of the present disclosure, and FIG. 12 is a view illustrating a state in which refrigerant suctioned into a main body is distributed and transferred by a refrigerant distribution unit of a scroll compressor according to a fourth embodiment of the present disclosure.

As illustrated in FIG. 10, at least a portion of a refrigerant distribution unit 220 may be provided above the suction pipe 12. The refrigerant distribution unit 220 may include a communication port 221 communicating with the inlet port 47 of the fixed scroll 40 so as to communicate with the compression chamber 60, a guide portion 223 to guide a part of the refrigerant suctioned through the suction pipe 12 to the communication port 221, an opening 225 provided at a lower end of the guide portion 223 to allow a remaining part of the refrigerant suctioned through the suction pipe 12 to be transferred to the drive unit 20, and a distribution partition 227 to distribute the refrigerant suctioned through the suction pipe 12 to the communication port 221 and the opening 225.

The lower end of the guide portion 223 provided with the opening 225 may extend lower than the suction pipe 12, and the distribution partition 227 may be positioned lower than a center of an inner diameter of the suction pipe 12.

When the distribution partition 227 is located lower than the center of the inner diameter of the suction pipe 12, a large amount of refrigerant in the refrigerant suctioned through the suction pipe 12 may be guided upward by the distribution partition 227 and transferred to the compression chamber 60 through the communication port 221, and a small amount of refrigerant may be transferred to the drive unit 20 through the opening 225 (See FIG. 2).

As illustrated in FIG. 11, a refrigerant distribution unit 230 may be disposed above the suction pipe 12. The refrigerant distribution unit 230 may include a communication port 231 communicating with the inlet port 47 of the fixed scroll 40 to communicate with the compression chamber 60 and a connection portion 233 to connect a portion of the suction pipe 12 and the communication port 231 (See FIG. 2).

The connection portion 233 may be connected to the suction pipe 12 such that an amount of the refrigerant transferred through the connecting portion 233 is larger than an amount of refrigerant transferred to the outside of the connecting portion 233.

As illustrated in FIG. 12, a refrigerant distribution unit 240 may be disposed above the suction pipe 12. The refrigerant distribution unit 240 may include a communication port 241 communicating with the inlet port 47 of the fixed scroll 40 to communicate with the compression chamber 60, a connection portion 243 to connect the suction pipe 12 and the communication port 241, and an opening 245 provided in the connection portion 243 such that a part of the refrigerant transferred to the connection portion 243 is transferred to the drive unit 20 (See FIG. 2).

The size of the opening 245 may be relatively smaller than the size of the communication port 241 such that a part of the refrigerant suctioned through the suction pipe 12 is transferred to the driving unit 20 through the opening 245.

Although a few embodiments of the present disclosure have been shown and described, it is to be understood that the disclosure is not limited to the disclosed embodiments. It would be appreciated by those skilled in the art that changes may be made in these embodiments without departing from the principles and spirit of the invention, the scope of which is defined in the claims and their equivalents.

The invention claimed is:

1. A scroll compressor comprising:

a main body;

a fixed scroll fixedly installed in the main body;

an orbiting scroll configured to engage with the fixed scroll and perform a relative orbiting motion, and to form a compression chamber with the fixed scroll;

a partition plate disposed above the fixed scroll to separate an inside of the main body into a low-pressure portion and a high-pressure portion;

a valve seat member attached to the partition plate;

a first check valve installed at a discharge port of the fixed scroll to open and close the discharge port;

a second check valve mounted on the valve seat member to open and close an opening allowing communication between the low-pressure portion and the high-pressure portion;

a back pressure chamber disposed between the fixed scroll and the partition plate, and formed by a discharge guide provided on the fixed scroll and a back pressure actuator installed on the discharge guide to be movable in a vertical direction; and a sealing member disposed to seal a gap, between the discharge guide and the back pressure actuator to seal the back pressure chamber, wherein during operation of the scroll compressor, the back pressure actuator moves upward so as to be in close contact with a lower portion of the valve seat member by a high pressure of the back pressure chamber such that the inside of the main body is separated into the high-pressure portion and the low-pressure portion, wherein while the scroll compressor is stopped, the back pressure actuator moves downward to be separated from the valve seat member by a low pressure of the back pressure chamber such that a pressure difference is relieved inside the main body, and while the scroll compressor is stopped, the sealing member is moved upward by a high pressure of the back pressure chamber such that refrigerant in the back pressure chamber flows out of the back pressure chamber through the gap.

2. The scroll compressor according to claim 1, wherein a volume of a space where a high pressure is formed between the first check valve and the second check valve during operation of the scroll compressor is 20% to 200% of a total suction volume.

3. The scroll compressor according to claim 1, wherein the first check valve moves in a vertical direction along a plurality of guides to open and close the discharge port, and the second check valve moves in the vertical direction along a plurality of guides to open and close the opening.

4. The scroll compressor according to claim 1, wherein the first check valve and the second check valve comprise a steel plate having a thickness of 1 mm or less.

5. The scroll compressor according to claim 1, wherein a hardness of the valve seat member is higher than a hardness of the back pressure actuator.

6. The scroll compressor according to claim 1, wherein the sealing member is provided in a ring shape having a rectangular cross section.

7. The scroll compressor according to claim 6, wherein the sealing member has a cutout portion that is partially cut for the sealing member to be movable in the vertical direction, and the cutout portion has an inclined surface.

8. The scroll compressor according to claim 1, wherein a ring-shaped wave spring is disposed on the sealing member to move the sealing member which is moved upward downward to seal the gap.

9. The scroll compressor according to claim 1, wherein while the scroll compressor is stopped, the first check valve closes the discharge port to prevent a reverse rotation in which high pressure refrigerant discharged through the discharge port flows back into the discharge port and the second check valve closes the opening to prevent the refrigerant in the high-pressure portion from moving to the low-pressure portion.

* * * * *